US007642294B2

(12) United States Patent
Cruijsberg et al.

(10) Patent No.: US 7,642,294 B2
(45) **Date of Patent: *Jan. 5, 2010**

(54) PROCESS TO PREPARE LOWER OLEFINS FROM A CARBON CONTAINING FEEDSTOCK

(75) Inventors: Emil Eduard Antonius Cruijsberg, Amsterdam (NL); Jan Lodewijk Maria Dierickx, Amsterdam (NL); Arend Hoek, Amsterdam (NL); Johannes Marie Gemma Van Schijndel, Amsterdam (NL); Jeroen Van Westrenen, Amsterdam (NL)

(73) Assignee: Shell Oil Company, Houston, TX (US)

( * ) Notice: Subject to any disclaimer, the term of this patent is extended or adjusted under 35 U.S.C. 154(b) by 73 days.

This patent is subject to a terminal disclaimer.

(21) Appl. No.: 11/664,657

(22) PCT Filed: Oct. 6, 2005

(86) PCT No.: PCT/EP2005/055078

§ 371 (c)(1),
(2), (4) Date: Apr. 4, 2007

(87) PCT Pub. No.: WO2006/037805

PCT Pub. Date: Apr. 13, 2006

(65) Prior Publication Data

US 2007/0265359 A1 Nov. 15, 2007

(30) Foreign Application Priority Data

Oct. 8, 2004 (EP) ..... 04104947

(51) Int. Cl.
*C07C 27/00* (2006.01)
*C10G 47/02* (2006.01)
*C10G 35/00* (2006.01)

(52) U.S. Cl. ..... 518/700; 518/702; 518/703; 518/704; 208/108; 208/133

(58) Field of Classification Search ..... 518/700–704; 208/108, 133
See application file for complete search history.

(56) References Cited

U.S. PATENT DOCUMENTS

| | | | | |
|---|---|---|---|---|
| 4,498,629 | A | 2/1985 | Grondman | 239/434.5 |
| 4,836,831 | A | 6/1989 | Martens | 48/197 |
| 4,943,672 | A | 7/1990 | Hamner et al. | 585/737 |
| 5,059,299 | A | 10/1991 | Cody et al. | 208/27 |
| 5,370,788 | A | 12/1994 | Dai et al. | 208/111 |
| 5,378,348 | A | 1/1995 | Davis et al. | 208/27 |
| 5,620,670 | A * | 4/1997 | Benham et al. | 422/213 |
| 5,803,724 | A | 9/1998 | Oortwijn et al. | 431/4 |
| 5,931,978 | A | 8/1999 | Oortwijn et al. | 48/127.1 |
| 6,376,732 | B1 | 4/2002 | Ngan et al. | 585/800 |
| 2003/0135077 | A1 | 7/2003 | O'Rear et al. | 585/613 |
| 2004/0004028 | A1 | 1/2004 | Stell et al. | 208/130 |
| 2004/0152793 | A1 * | 8/2004 | O'Rear et al. | 518/726 |

FOREIGN PATENT DOCUMENTS

| | | |
|---|---|---|
| EP | 0321305 | 12/1988 |
| EP | 532118 | 3/1993 |
| EP | 583836 | 2/1994 |
| EP | 668342 | 8/1995 |
| EP | 759886 | 3/1997 |
| EP | 772568 | 5/1997 |
| EP | 776959 | 6/1997 |
| GB | 791634 | 3/1958 |
| GB | 1461989 | 1/1977 |
| GB | 7712952 | 5/1979 |
| GB | 7811821 | 10/1979 |
| GB | 2146350 | 4/1985 |
| GB | 2371807 | 8/2002 |
| GB | 2386607 | 9/2003 |
| WO | 9920720 | 4/1999 |
| WO | 9934917 | 7/1999 |
| WO | 0014179 | 3/2000 |
| WO | 0166672 | 9/2001 |
| WO | 02070630 | 9/2002 |
| WO | 03036166 | 5/2003 |
| WO | 03040262 | 5/2003 |
| WO | 2003062352 | 7/2003 |
| WO | 2004092060 | 10/2004 |
| WO | 2004092061 | 10/2004 |
| WO | 2004092062 | 10/2004 |
| WO | 2004092063 | 10/2004 |

OTHER PUBLICATIONS

International Search Report dated Jan. 31, 2006.

* cited by examiner

*Primary Examiner*—Jafar Parsa

(57) ABSTRACT

A process is provided to make ethylene and propylene from a carbonaceous feedstock. The process comprises preparing a gaseous mixture of carbon monoxide and hydrogen from a feedstock. A Fischer Tropsch synthesis is then performed on the gaseous mixture to obtain a Fischer Tropsch product along with unconverted carbon monoxide and hydrogen. The Fischer Tropsch product in admixture with the unconverted carbon monoxide and hydrogen from the previous step is then subjected to terminal cracking to form ethylene and propylene.

14 Claims, 1 Drawing Sheet

PROCESS TO PREPARE LOWER OLEFINS FROM A CARBON CONTAINING FEEDSTOCK

The present application claims priority to European Patent Application 04104947.9 filed 8 Oct. 2004.

FIELD OF THE INVENTION

The invention is directed to a process to prepare lower olefins from a carbon containing feedstock.

BACKGROUND OF THE INVENTION

Various processes are known which convert methane to lower olefins. An example is a process wherein methane is converted to synthesis gas, which in turn is converted to a paraffinic product by means of the Fischer-Tropsch reaction. By using for example the naphtha paraffin product as isolated from said Fischer-Tropsch product as steam cracker feedstock, lower olefins may be prepared. This route is applied on a commercial scale. For example, in "The Markets for Shell Middle Distillate Synthesis Products", Presentation of Peter J. A. Tijm, Shell International Gas Ltd., Alternative Energy '95, Vancouver, Canada, May 2-4, 1995 on page 5, it is mentioned that SMDS naphtha, the Fischer-Tropsch derived naphtha fraction of the Shell MDS process, is used as steam cracker feedstock in for example Singapore.

The above commercial process involves that a naphtha feedstock is made in the Fischer-Tropsch process, is transported to a steam cracker, in which the lower olefins are prepared. This process is cumbersome due to the large number of process steps and transport. There is a need for a more integrated process. The following process provides just such a process.

SUMMARY OF THE INVENTION

Process to make ethylene and/or propylene from a carbonaceous feedstock by performing the following steps, (aa) preparing a mixture of carbon monoxide and hydrogen from said feedstock, (bb) performing a Fischer-Tropsch synthesis step using the gaseous mixture obtained in step (aa) to obtain a Fischer-Tropsch product, in admixture with the unconverted carbon monoxide and hydrogen, (cc) performing a thermal cracking step on the Fischer-Tropsch product in admixture with the unconverted carbon monoxide and hydrogen of step (bb).

BRIEF DESCRIPTION OF THE DRAWING

The FIGURE is a schematic illustration of a preferred embodiment of the present invention.

DETAILED DESCRIPTION OF THE INVENTION

Figure 1:
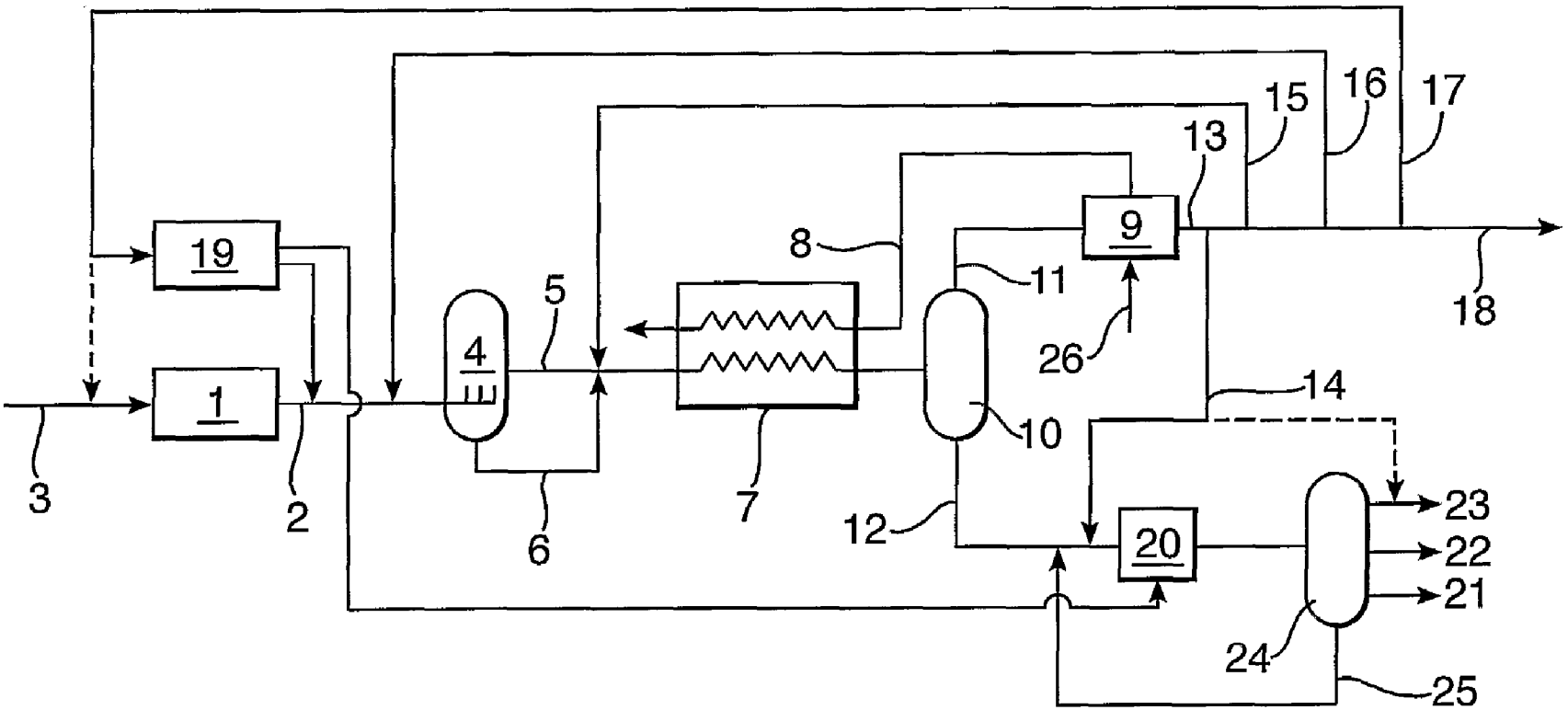

Applicants found that the Fischer-Tropsch synthesis product can be used directly as feed to a thermal cracking step. By using the gaseous compounds present in the effluent of step (bb) as a dilution gas in step (cc), separation of these gases between steps (bb) and (cc) can be avoided. Further preferred embodiments will be discussed below.

The carbonaceous feedstock used in step (aa) may be any carbon-containing stream, which is capable of being converted to a mixture of hydrogen and carbon monoxide.

Examples of such feedstocks are coal, for example anthracite, brown coal, bitumous coal, sub-bitumous coal, lignite and petroleum coke, bituminous oils, for example ORIMULSION (trade mark of Intevep S.A., Venezuela), biomass, for example woodchips, mineral crude oil or fractions thereof, for example residual fractions of said crude oil, and methane containing feedstocks, for example refinery gas, coal bed gas, associated gas, natural gas. Possible feeds for step (aa) and processes to be used are well known and described in "Gasification" by C. Higman and M van der Burgt, Elsevier Science (USA), 2003, ISBN 0-7506-7707-4, chapters 4 and 5. Preferably, when processing an ash containing feed like coal or petroleum coke, step (aa) is performed by a non-catalyzed partial oxidation process as for example the Shell Coal Gasification Process as described in said reference book. If the feedstock is a residual fraction of a crude oil, the preferred process is to use a non-catalyzed partial oxidation as for example the Shell Gasification Process, as for example described in said reference book and also by Heurich et al. in "Partial Oxidation in the Refinery Hydrogen Management Scheme", AIChE 1993 Spring Meeting, Houston, 30 Mar. 1993, and the TEXACO process, as described in Petroleum Review June 1990, page 311-314. In a preferred embodiment step (aa) is performed starting from a gaseous hydrocarbon feed, more preferably a methane containing feed, even more preferably natural gas.

Starting from a gaseous hydrocarbon feed, more processes may be used to prepare the mixture of carbon monoxide and hydrogen. Suitable processes are reforming, steam reforming, autothermal steam reforming, convective steam reforming, catalyzed or non-catalyzed partial oxidation and combinations of said processes. Such processes are for example described in U.S. Pat. No. 4,836,831, EP-A-759886, EP-A-772568, U.S. Pat. Nos. 5,803,724 5,931,978, WO-A-03036166, WO-A-2004092060, WO-A-2004092061, WO-A-2004092062, WO-A-2004092063.

The mixture of hydrogen and carbon monoxide, also referred to as syngas, as obtained in step (aa) is used in step (bb). If required the hydrogen to carbon monoxide molar ratio is adapted for the specific catalyst and process used in step (bb). The $H_2/CO$ molar ratio in syngas formed by gasification is generally about or less than 1, and is commonly about 0.3-0.6 for coal-derived syngas, and 0.5-0.9 for heavy residue-derived syngas. It is possible to use such a $H_2/CO$ ratio in step (bb), but more satisfactory results can be achieved by increasing the $H_2/CO$ ratio. This can be suitably performed by a water gas shift reaction or by adding hydrogen to the syngas mixture. Preferably the $H_2/CO$ ratio in the syngas stream formed by the combination of the sub-streams is greater than 1.5, preferably in the range 1.6-1.9, and more preferably in the range 1.6-1.8.

In step (bb) the Fischer-Tropsch reaction converts carbon monoxide and hydrogen into longer chain, usually paraffinic, hydrocarbons:

$$n(CO+2H_2)=(-CH_2-)_n+nH_2O+\text{heat},$$

in the presence of an appropriate catalyst and typically at elevated temperatures, for example 125 to 300° C., preferably 175 to 250° C., and/or pressures, for example 5 to 100 bar, preferably 12 to 80 bar.

Typical catalysts for the Fischer-Tropsch synthesis of paraffinic hydrocarbons comprise, as the catalytically active component, a metal from Group VIII of the periodic table, in particular ruthenium, iron, cobalt or nickel. Suitable such catalysts are described for instance in EP-A-0583836. The Fischer-Tropsch reactor may be for example a multi-tubular reactor or a slurry reactor. Examples of possible Fischer-Tropsch synthesis processes are, for example the so-called commercial Sasol process, the Shell Middle Distillate Synthesis Process (SMDS) or ExxonMobil's ACG-21 process. These and other processes are for example described in more detail in EP-A-776959, EP-A-668342, U.S. Pat. Nos. 4,943,672, 5,059,299, WO-A-9934917 and WO-A-9920720. Typically, these Fischer-Tropsch synthesis products will comprise hydrocarbons having 1 to 100 and even more than 100 carbon atoms. The hydrocarbon product will comprise normal paraffins, iso-paraffins, oxygenated products, and unsaturated products. The content of aromatics will be lower than 10 wt %, preferably lower than 5 wt %. The content of naphthenic compounds will be lower than 10 wt %, and preferably lower than 5 wt.

Preferably the direct product of step (bb) is used in step (cc). Direct product here means that the synthesis product of the Fischer-Tropsch reaction is not chemically altered by treatments such as hydrogenation, hydrocracking or catalytic cracking. Possibly fractions of the Fischer-Tropsch reaction product may be used. For example in a Fischer-Tropsch reactor, a gaseous product and a liquid product may be obtained separately and used in combination in step (cc) or alone. The gaseous product may be fed to step (cc) directly, while from the liquid product, first a high boiling fraction is separated, before it is used as feed in step (cc). This is advantageous when step (cc) is performed in a pyrolysis furnace as described below. In these pyrolysis furnaces it has been found advantageous to perform the thermal cracking reaction in the gaseous phase to reduce coking. By separating the Fischer-Tropsch molecules, which do not evaporate under the conditions of step (cc), excessive coking is avoided.

In a preferred embodiment, the separation of the high boiling compounds of the Fischer-Tropsch synthesis product is performed by evaporating the low boiling compounds in the presence of the dilution gas used in step (cc) in a gas and a liquid fraction, and separating the liquid fraction from the remaining gas and low boiling compounds. Preferably the gaseous Fischer-Tropsch product directly isolated from the Fischer-Tropsch reactor is also present during said evaporation. The gas/oil mixture as obtained is preferably further heated before this mixture is fed to the actual pyrolysis zone of step (cc).

The process according to the present invention uses a Fischer-Tropsch synthesis product in step (cc) as feed. The Fischer-Tropsch synthesis product may be present on its own as a 100% Fischer-Tropsch derived feed, or in admixture with other suitable feedstocks that can be used in the preferred pyrolysis furnace. If such additional feedstocks are present, the present process makes it possible to start with a feedstock comprising a high boiling non-evaporating fraction. This non-evaporating fraction may be added to the heavy Fischer-Tropsch product and subjected to the evaporation step described above. Such additional feedstocks are suitably light crude oil feedstocks, which have the following characteristics. Each boiling range characterization of the feedstock is measured according to ASTM D-2887: 85 wt % or less and preferably 65 wt % or less of the feedstock will vaporize at 350° C., and 90 wt % or less or preferably 75 wt % or less of the feedstock will vaporize at 400° C. Typical preferred crude oil feedstocks will have API gravities smaller than 45. Feedstocks within the above range of characteristics minimize coking within the tubes of the convection section of a pyrolysis furnace, under the operating conditions described herein.

Suitable examples of other suitable feedstocks which can be present next to the Fischer-Tropsch derived feed are mineral oil derived naphtha, kerosene and gas oil. Preferably the additional source is a crude oil feedstock or the long residue of a crude oil atmospheric distillation or a gas field condensate. Examples of suitable crude sources for the present invention are so-called waxy crudes, for example Gippsland, Bu Attifel, Bombay High, Minas, Cinta, Taching, Udang, Sirikit and Handil. Such feedstocks will contain so-called pitch, which will be removed effectively by the process according to the present invention as the liquid fraction. Co-processing a crude oil feed or a gas field condensate product in combination with a Fischer-Tropsch derived product is advantageous because high yields to lower olefins can be achieved in combination with logistic advantages and longer furnace run lengths. Fischer-Tropsch synthesis processes run typically on natural gas in remote regions where also crude oil is found. By co-processing these hydrocarbon sources, logistic and fouling problems are overcome.

The bottoms of an atmospheric distillation column used to process and fractionate desalted crude oil, are commonly known as atmospheric tower bottoms or long residue. This atmospheric distillation column separates diesel, kerosene, naphtha, gasoline, and lighter components from the crude. Long residues can be advantageously admixed with the Fischer-Tropsch product. Preferred properties of the long residues are that 35 wt % or less, more preferably 15 wt % or less, and even 10 wt % or less vaporizes at 350° C., and 55 wt % or less, more preferably 40 wt %, and even 30 wt % or less, vaporizes at 400° C.

The pressure and temperature in the above referred to evaporating step is not critical as long as the feedstock is flowable. The pressure generally ranges from between 7 and 30 bar, more preferably from 11 to 17 bar, and the temperature of the feedstock is generally set from ambient to 300° C., preferably from 140° C. to 300° C. Preferably the evaporating step is performed in the first stage preheater in the convection zone of a pyrolysis furnace. Feed rates are not critical, although it would be desirable to conduct a process at a feedrate ranging from 17 to 200 and more preferably from 25 to 50 tons of feedstock per hour. The first stage preheater in the convection section is typically a bank of tubes, wherein the contents in the tubes are heated primarily by convective heat transfer from the combustion gas exiting from the radiant section of the pyrolysis furnace. In one embodiment, as the feedstock travels through the first stage preheater, it is heated to a temperature which promotes evaporation of non-coking fractions into a vapor state and evaporation of a portion of coking fractions into a vapor state, while maintaining the remainder of the coking fractions in a liquid state. We have found that with a feedstock comprising a Fischer-Tropsch feedstock, it is desirable to fully evaporate the feed fraction which does not promote coking in the first stage preheaters, and in addition, maintain a temperature sufficiently elevated to further evaporate a portion of the feedstock compounds comprised of fractions which promote coking of the tubes in the first stage preheater and/or the second stage preheater. The coking phenomenon in the first stage preheater tubes is substantially diminished by maintaining a wet surface on the walls of the heating tubes. So long as the heating surfaces are wetted at a sufficient liquid superficial velocity, the coking of those surfaces is inhibited.

The optimal temperature at which the feedstock is heated in the first stage preheater of the convection zone will depend upon the particular feedstock composition, the pressure of the feedstock in the first stage preheater, and the performance and operation of the vapor/liquid separator. In one embodiment of the invention, the feedstock is heated in the first stage preheater to an exit temperature of at least 375° C., and more preferably to an exit temperature of at least 400° C. In one embodiment, the exit temperature of the feedstock from the first stage preheater is at least 415° C. Preferably, the exit temperature of the feedstock within the first stage preheater is not more than about 520° C., and most preferably not more than 500° C.

Each of the temperatures identified above in the first stage preheater are measured as the temperature the gas-liquid mixture attains at any point within the first stage preheater, including the exit port of the first stage preheater. Recognizing that the temperature of the feedstock inside the tubes of the first stage preheater changes over a continuum, generally rising, as the feedstock flows through the tubes up to the temperature at which it exits the first stage preheater, it is desirable to measure the temperature at the exit port of the first stage preheater from the convection zone of the furnace. At these exit temperatures, a coke promoting fraction will be evaporated into a gas phase, while maintaining the remainder of the coke promoting fraction in a liquid phase in order to adequately wet the walls of all heating surfaces. The gas-liquid ratio after evaporation in said evaporation step is preferably in the range from 60/40-98/2 by weight, more preferably 90/10-95/5 by weight, in order to maintain a sufficiently wetted tube wall, minimize coking, and promote increased yields.

In an optional but preferred embodiment of the invention, the dilution gas comprising the unconverted carbon monoxide and hydrogen is added to the feedstock of the first stage preheater at a point external to the pyrolysis furnace for ease of maintaining and replacing equipment, if not already present in the Fischer-Tropsch synthesis product. Any additional dilution gas, which may be recycled carbon dioxide or off-gases of optional hydroconversion processes, is preferably added prior to the above described evaporation step.

The dilution gas feed also assists in maintaining the flow regime of the feedstock through the tubes, whereby the tubes remain wetted, and avoids a stratified flow. Examples of gases which may be present next to the unconverted hydrogen and carbon monoxide are dilution steam (saturated steam at its dewpoint), methane, ethane, nitrogen, hydrogen, natural gas, dry gas, or a vaporized naphtha. Preferred additional gases are carbon dioxide, gas-to-liquids plant off-gas, more preferably a propane comprising off-gas, vaporized naphtha, or mixtures thereof.

The unconverted carbon monoxide and hydrogen of step (bb) used in step (cc) as dilution gas may advantageously be recovered in the so-called cold box of a typical pyrolysis process, which may be performed in step (cc). The so-obtained purified synthesis gas is preferably recycled to the Fischer-Tropsch synthesis step (bb). Alternatively, it may also suitably be recycled to the synthesis gas manufacturing step (aa).

If carbon dioxide is present in the dilution gas, it will partially be converted to carbon monoxide in the thermal cracking step (cc). Thus, by adding carbon dioxide as isolated in the process to step (cc), a method is obtained to convert it to carbon monoxide which in turn may be used in step (bb). One source of carbon dioxide is the carbon dioxide as preferably separated from the cracked effluent in the $CO_2$ absorber, which is located upstream of, or integrated with, the pyrolysis process' cracked gas compression section. The carbon dioxide is preferably recycled to the above referred to evaporation step. The carbon monoxide and hydrogen is preferably separated from the cracked gas as a mixture of methane, carbon monoxide, and hydrogen. Also a stream of relatively pure methane may be obtained in this purification step. In a typical pyrolysis process, this methane is used to fire the pyrolysis furnaces. In the present process, this methane is preferably used as feed to either prepare hydrogen in a process to prepare hydrogen, suitably by means of steam reforming, or added to the feed for step (aa) to prepare carbon monoxide and hydrogen.

In another preferred embodiment, the liquid Fischer-Tropsch fraction as obtained in the evaporation step is subjected to a mild thermal cracking process. The mild thermal conversion step may be any mild thermal cracking process known in the art which is preferably performed in the absence of a dilution gas. Very suitably, the thermal cracking is a furnace cracking process, but it is preferably a soaker visbreaking process. In the soaker visbreaking process the feed is heated in a furnace to a temperature suitably between 380 and 500° C., preferably between 400 and 480° C., suitably using a residence time of up to 5 minutes, preferably up to 3 minutes, followed by further conversion in a soaker vessel. The residence time in the soaker vessel is suitably between 0.5 and 2 hours. The pressure is usually between 3 and 10 bar. The conversion, of material boiling above 550° C. to material boiling below 550° C., obtained is suitably at least 20 wt %, preferably at least 60 wt %. Especially the conversion is between 30 and 98 wt % of the material boiling above 550° C., preferably between 60 and 95 wt %. Preferably at least 99 wt % of the material boiling above 750° C. is removed, more preferably at least 99 wt % of the material boiling above 650° C. is removed. In the case of furnace cracking the temperature is suitably between 420 and 540° C., preferably between 460 and 520° C., the pressure is suitably between 5 and 50 bar, preferably between 15 and 20 bar and the residence time is suitably between 1 and 15 minutes, especially between 4 and 12 minutes. The conversion levels are the same as for the soaker process.

The product obtained in the mild thermal cracking process is preferably recycled to step (cc). Preferably the product is separated into a light fraction and a heavy fraction, more preferably this separation is performed in the above referred to evaporation step. Alternatively separation may be performed by means of a flash separation. The light fraction suitably boils up to 450° C., preferably up to 500° C., more preferably up to 550° C. or even 650° C. The heavy fraction may be recycled to the mild thermal cracking step. In the case of a recycle it is preferred to remove between 5 and 40 wt % of the stream as a bleed stream. Such a bleed stream is advantageously used as fuel, either in the mild thermal cracking step or in the second cracking step.

In a further embodiment of the invention, the product obtained in the mild thermal cracking process may be hydrogenated before being used in step (cc).

In another preferred embodiment, the liquid Fischer-Tropsch fraction as obtained in the evaporation step is preferably subjected to a catalytic cracking process, of which the fluid catalytic cracking (FCC) process is an example. The process is advantageous because a relatively high octane gasoline may be obtained from such a process when compared to the traditional processes involving hydroprocessing a Fischer-Tropsch derived feed. Products boiling above gasoline as obtained in said process may be advantageously recycled to step (cc). In such a catalytic cracking process the feed will preferably be contacted with a catalyst at a temperature between 450 and 650° C. More preferably the temperature is above 475° C. The temperature is preferably below 600° C. to avoid excessive overcracking to gaseous compounds. The process may be performed in various types of reactors. Because the coke make is relatively small as compared to a FCC process operating on a petroleum derived feed it is possible to conduct the process in a fixed bed reactor. In order to be able to regenerate the catalyst more simply preference is nevertheless given to either a fluidized bed reactor or a riser reactor. If the process is performed in a riser reactor the preferred contact time is between 1 and 10 seconds and more preferred between 2 and 7 seconds. The catalyst to oil ratio is preferably between 2 and 20 kg/kg. It has been found that good results may be obtained at low catalyst to oil ratios of below 15 and even below 10 kg/kg.

The catalyst system used in the catalytic cracking process in step will at least comprise of a catalyst comprising of a matrix and a large pore molecular sieve. Examples of suitable large pore molecular sieves are of the faujasite (FAU) type as for example Zeolite Y, Ultra Stable Zeolite Y and Zeolite X. The matrix is preferably an acidic matrix. Examples of suitable catalysts are the commercially available FCC catalysts. The catalyst system may advantageously also comprise of a medium pore size molecular sieve such to also obtain a high yield of propylene in addition to the gasoline fraction. Preferred medium pore size molecular sieves are zeolite beta, Erionite, Ferrierite, ZSM-5, ZSM-11, ZSM-12, ZSM-22, ZSM-23 or ZSM-57. The weight fraction of medium pore crystals on the total of molecular sieves present in this process is preferably between 2 and 20 wt %.

In another preferred embodiment, the liquid Fischer-Tropsch fraction as obtained in the evaporation step is preferably subjected to a hydroconversion/hydroisomerisation step yielding an effluent, which may as a whole or in part be used as additional feed in step (cc). Preferably from this effluent a naphtha, kerosene and/or gas oil product is isolated and used as a fuel product or fuel component. This hydroconversion/hydroisomerisation step is preferably performed in the presence of hydrogen and a catalyst, which catalyst can be chosen from those known to one skilled in the art as being suitable for this reaction. Catalysts typically are amorphous catalysts comprising an acidic functionality and a hydrogenation/dehydrogenation functionality. Preferred acidic functionality's are refractory metal oxide carriers. Suitable carrier materials include silica, alumina, silica-alumina, zirconia, titania and mixtures thereof. Preferred carrier materials for inclusion in the catalyst for use in the process of this invention are silica, alumina and silica-alumina. A particularly preferred catalyst comprises platinum supported on a silica-alumina carrier. If desired, but generally not preferred because of environmental reasons, the acidity of the catalyst carrier may be enhanced by applying a halogen moiety, in particular fluorine or chlorine to the carrier. Examples of suitable hydrocracking/hydroisomerisation processes and suitable catalysts are described in WO-A-200014179, EP-A-532118 and the earlier referred to EP-A-776959.

Preferred hydrogenation/dehydrogenation functionality's are Group VIII non-noble metals, for example nickel as described in WO-A-0014179, U.S. Pat. No. 5,370,788 or U.S. Pat. No. 5,378,348 and more preferably Group VIII noble metals, for example palladium and most preferably platinum. The catalyst may comprise the hydrogenation/dehydrogenation active component in an amount of from 0.005 to 5 parts by weight, preferably from 0.02 to 2 parts by weight, per 100 parts by weight of carrier material. A particularly preferred catalyst for use in the hydroconversion stage comprises platinum in an amount in the range of from 0.05 to 2 parts by weight, more preferably from 0.1 to 1 parts by weight, per 100 parts by weight of carrier material. The catalyst may also comprise a binder to enhance the strength of the catalyst. The binder can be non-acidic. Examples are clays and other binders known to one skilled in the art. Preferably the catalyst is substantially amorphous, meaning that no crystalline phases are present in the catalyst. In the hydroconversion/hydroisomerisation step the high boiling Fischer-Tropsch fraction is contacted with hydrogen in the presence of the catalyst at elevated temperature and pressure. The temperatures typically will be in the range of from 175 to 380° C., preferably higher than 250° C. and more preferably from 300 to 370° C. The pressure will typically be in the range of from 10 to 250 bar and preferably between 20 and 80 bar. Hydrogen may be supplied at a gas hourly space velocity of from 100 to 10000 Nl/l/hr, preferably from 500 to 5000 Nl/l/hr. The hydrocarbon feed may be provided at a weight hourly space velocity of from 0.1 to 5 kg/l/hr, preferably higher than 0.5 kg/l/hr and more preferably lower than 2 kg/l/hr. The ratio of hydrogen to hydrocarbon feed may range from 100 to 5000 Nl/kg and is preferably from 250 to 2500 Nl/kg. The conversion as defined as the weight percentage of the feed boiling above 370° C. which reacts per pass to a fraction boiling below 370° C. is preferably at least 20 wt %, more preferably at least 25 wt %, preferably not more than 80 wt %.

It is well known from for example the experience of the Shell MDS Malaysia that the gas oil is an excellent automotive fuel component. The naphtha however cannot be directly used as a gasoline blending component due to its low octane number. Applicants now found that by blending this naphtha product with the gasoline fraction, also referred to as pyrolysis gasoline, isolated from the effluent of step (cc), a better gasoline product in terms of octane number is obtained. In a preferred embodiment, the pyrolysis gasoline is fed to the above described hydroconversion/hydroisomerisation step. It has been found that this will not negatively influence the yield of the final blend while advantageously lowering the olefin content of the final gasoline blend. The invention is therefore also directed to the more general process of adding a pyrolysis gasoline product as may be obtained from any type of steam cracking process to a Fischer-Tropsch derived feed and subsequently subjecting said mixture to a hydroconversion/hydroisomerisation step for which the preferred catalysts and reaction conditions are described above in detail.

Pyrolysis gasoline may also be advantageously blended with the gasoline fraction as obtained in the possible catalytic cracking process as described above.

In another preferred embodiment, the liquid Fischer-Tropsch fraction as obtained in the evaporation step is recycled to step (aa) to be converted to syngas or used to fire the pyrolysis furnaces as used in a preferred embodiment of step (cc). The latter may be advantageous when the process is carried out in an environment wherein the traditional fuels are not readily available. For example when the starting carbonaceous feed for step (aa) is coal it is more preferred to use the methane as separated from the cracked effluent as feedstock to prepare hydrogen or mixtures of hydrogen and carbon monoxide and use the residual high boiling Fischer-Tropsch fraction as fuel in said pyrolysis furnace.

If the dilution gas is added to the Fischer-Tropsch product the temperature of the dilution gas is at a minimum sufficient to maintain the stream in a gaseous state. With respect to dilution gas, it is preferably added at a temperature below the temperature of the crude oil feedstock measured at the injection point, to ensure that any water, which may be the dilution gas itself or may be present as contaminant in some of the above referred to dilution gases, does not condense. This temperature is more preferably 25° C. below the feedstock temperature at the injection point. Typical dilution gas temperatures at the dilution gas/feedstock junction range from 140° C. to 260° C., more preferably from 150° C. to 200° C.

The pressure of dilution gas is not particularly limited, but is preferably sufficient to allow injection. Typical dilution gas pressure added to the crude oil is generally within the range of 6 to 15 bar.

It is desirable to have the dilution gas present in the first stage preheater in an amount up to 0.5:1 kg of gas per kg of oil, preferably up to 0.3:1 kg of gas per kg of oil, wherein the oil is the Fischer-Tropsch product and any optional additional mineral feeds.

Once the hydrocarbon feedstock has been heated to produce a gas-liquid mixture, it is withdrawn from the first stage preheater directly or indirectly to a vapor/liquid separator as a heated gas-liquid mixture. The vapor/liquid separator removes the non-vaporized portion of the feedstock, which is withdrawn and separated from the fully vaporized gases of the feedstock. The vapor/liquid separator can be any separator, including a cyclone separator, a centrifuge, or a fractionation device commonly used in heavy oil processing. The vapor/liquid separator can be configured to accept side entry feed wherein the vapor exits the top of the separator and the liquids exit the bottom of the separator, or a top entry feed wherein the product gases exit the side of the separator.

The vapor/liquid separator operating temperature is sufficient to maintain the temperature of the gas-liquid mixture within the range of 375° C. to 520° C., preferably within the range of 400° C. to 500° C. The vapor/liquid temperature can be adjusted by any means, including increasing a flow of superheated dilution gas to the gas-liquid mixture destined for the vapor/liquid separator and/or by increasing the temperature of the feedstock to the furnace from external heat exchangers. In a preferred embodiment, the vapor/liquid separator is used as described in U.S. Pat. No. 6,376,732, which publication is incorporated by reference.

The gaseous vaporized portion of the feed, as fed to the vapor/liquid separator as a gas-liquid mixture from the first stage preheater, is preferably and subsequently fed through a vaporizer mixer in which the vapor mixes with superheated gas, preferably superheated steam, to heat the vapor to a higher temperature. The vapor is desirably mixed with superheated gas, in order to ensure that the stream remains in a gaseous state, by lowering the partial pressure of the hydrocarbons in the vapor. Since the vapor exiting the vapor/liquid separator is saturated, the addition of superheated gas will minimize the potential for coking fractions in the vapor to condense on inner surfaces of the unheated external piping connecting the vapor/liquid separator to the second stage preheater. A suitable superheated gas temperature is not particularly limited at the high end, and is suitably sufficient to provide superheating above the dew point of the vapor. Generally, the superheated gas is introduced to the vaporizer mixer at a temperature ranging from about 450° C. to 600° C.

The vaporizer mixer is preferably located externally to the pyrolysis furnace, again for ease of maintenance. Any conventional mix nozzle may be used, but it is preferred to use a mix nozzle as described in U.S. Pat. No. 4,498,629, which document is fully incorporated herein by reference.

In case the process is operated on a substantially 100% Fischer-Tropsch derived feed, a source of sulphur is preferably added to the feed. In a preferred embodiment, the source of sulphur, for example DMDS, is added after performing the evaporation step and before performing the pyrolysis reaction. This is advantageous because then no sulphur will be added to the liquid fraction obtained in said evaporation step. This sulphur free high boiling Fischer-Tropsch product may be advantageously used in an optional hydroconversion/hydroisomerisation step, which step requires a sulphur free feedstock.

The gas/gas mixture as obtained in the said evaporation step is further increased in temperature before performing the pyrolysis step. Preferably the gas/gas mixture has a starting temperature in said heating step of 480° C., more preferably at least 510° C., most preferably at least 535° C. The temperature of the gas/gas mixture after performing said heating step is preferably at least 730° C., more preferably at least 760° C. and most preferably between 760° C. and 815° C. Said heating step is preferably performed in the second stage preheater of a pyrolysis furnace. In the second stage preheater, the gas/gas mixture flows through tubes heated by the flue gases from the radiant section of the furnace. In the second stage preheater the mixed gas/gas mixture is fully preheated to near or just below a temperature at which substantial feedstock cracking and associated coke laydown in the preheater would occur. The heated mixture is used in said pyrolysis reaction of step (cc).

Said pyrolysis reaction of step (cc) is preferably performed in the radiant section of a pyrolysis furnace, in which the gaseous hydrocarbons are thermally cracked to olefins and associated by products. Products of a pyrolysis furnace include, but are not limited to, ethylene, propylene, butadiene, benzene, hydrogen, and methane, and other associated olefinic, paraffinic, and aromatic products, such as a gasoline blending component, also referred to as pyrolysis gasoline. Ethylene is the predominant product, typically ranging from 15 to 40 wt %, based on the weight of the vaporized feedstock. The second important product is propylene. When reference is made to lower olefins, ethylene, propylene and $C_4$-olefins are meant.

The pyrolysis furnace may be any type of conventional pyrolysis furnace operated for production of lower molecular weight olefins, especially including a tubular gas cracking furnace. The tubes within the convection zone of the pyrolysis furnace may be arranged as a bank of tubes in parallel, or the tubes may be arranged for a single pass of the feedstock through the convection zone. At the inlet, the feedstock may be split among several single pass tubes, or may be fed to one single pass tube through which all the feedstock flows from the inlet to the outlet of the first stage preheater, and more preferably through the whole of the convection zone. Preferably, the first stage preheater is comprised of one single pass bank of tubes disposed in the convection zone of the pyrolysis furnace. In this preferred embodiment, the convection zone comprises a single pass tube having two or more banks through which the feed flows. Within each bank, the tubes may arranged in a coil or serpentine type arrangement within one row, and each bank may have several rows of tubes.

To further minimize coking in the tubes of the first stage preheater and in tubes further downstream and within the vapor/liquid separator, the superficial velocity of the feedstock flow should be selected such as to reduce the residence time of coking fraction vaporized gases in the tubes. An appropriate superficial velocity will also promote formation of a thin uniform wetted tube surface. While higher superficial velocities of feedstock through the tubes of the first stage preheater reduce the rate of coking, there is an optimum range of superficial velocity for a particular feedstock, beyond which the beneficial rates of coke reduction begin to diminish in view of the extra energy requirements needed to pump the feedstock and the sizing requirements of the tubes to accommodate a higher than optimum velocity range. In general, feedstock superficial velocity through the tubes of the first stage preheater in a convection section ranging from 1.1-2.2 m/s, more preferably from 1.7-2.1 m/s, and most preferably from 1.9-2.1 m/s, provide optimal results in terms of reducing the coking phenomenon balance against the cost of the tubes in furnace and the energy requirements.

The temperature of the product gas mixture in said pyrolysis reaction of step (cc) is preferably between 750 and 860° C. This latter temperature is sometimes referred to as the coil outlet temperature. The temperature of this gas is quickly reduced to terminate any unwanted reactions to a temperature of below 300° C. Examples of reducing the temperature are by means of well known transfer line exchangers and/or by means of a quench oil fitting. Preferably the temperature is reduced to below 440° C. by means of a transferline exchanger and further reduced to below 240° C. by means of a quench oil fitting. The product gas or cracked gas is further separated into the different products as listed above by well known and described processes known to the skilled person.

FIG. 1 illustrates a preferred embodiment of the present invention. In step (1) a syngas mixture of hydrogen and carbon monoxide (2) is prepared in step (aa) from feedstock (3) by non-catalyzed partial oxidation. The syngas mixture (2) is used as feed in Fischer-Tropsch reactor (4) yielding a gaseous product (5) and a liquid product (6) in step (bb). The gaseous and liquid products are combined and pre-heated in preheater (7), which is in indirect heat exchange with the flue gasses (8) of the radiant section of pyrolysis furnace (9). In gas liquid separator (10) a gas/oil mixture (11) and a heavy liquid fraction (12) is obtained. The gas/oil mixture is fed to the radiant section of pyrolysis furnace (9) to perform step (cc). The furnaces are fired by fuel (26). From the effluent (13) of step (cc), a pyrolysis gasoline product (14) is isolated, carbon dioxide (15) is isolated, a mixture of carbon monoxide and hydrogen (16) and methane (17) is isolated next to the traditional olefin products (18) as described above. The carbon dioxide (15) is recycled to pre-heater (7), the hydrogen and carbon monoxide (16) is recycled to the Fischer-Tropsch reactor (4) and the methane (17) is recycled to step (aa) or to a hydrogen-manufacturing step (19). The hydrogen prepared in such a step may be added to the syngas mixture (2) to optimise the hydrogen to CO ratio, or used in a hydrocracking/hydroisomerisation step (20). In this step (20) the liquid fraction (12) may be converted to high quality gas oil (21), kerosene (22) and naphtha (23) as isolated in atmospheric distillation step (24). The naphtha (23) may be blended with the pyrolysis gasoline (14) to obtain a gasoline-blending component by adding the pyrolysis gasoline (14) to the liquid (12) as part of the feed to the hydrocracking/hydroisomerisation step (20). The residue (25) as obtained in distillation (24) may be recycled to step (20), or optionally used as fuel in furnace (9). Optionally, the naphtha and kerosene products may be added to the feed of the pre-heater (7) if the value for the olefin products and pyrolysis gasoline is higher.

EXAMPLE 1

A mixture of a Fischer-Tropsch wax of which 10 wt % boils above 620° C. and hydrogen and carbon monoxide was heated to a temperature of 480° C. A syngas/hydrocarbon mixture was obtained wherein the hydrocarbons had the properties as listed in Table 1.

TABLE 1

| | |
|---|---|
| Liquid Density (d70/4) | 0.7397 |
| Refractive index ($n_D^{70}$) | 1.4140 |
| H/C ratio (at/at) | 2.13 |
| Sulphur (wt %) | <0.0010 |
| Initial boiling point (° C.) | 78 |
| 10 wt % (° C.) | 158 |
| 50 wt % (° C.) | 302 |
| 90 wt % (° C.) | 480 |
| 98 wt % (° C.) | 700 |

The syngas/hydrocarbon mixture was thermally cracked at a flow of 52 g/h hydrocarbons and at a steam flow of 43.7 Nl/h, a pressure of 2.15 bar absolute pressure and with a coil outlet temperature of between 800 and 860° C. in a quartz reactor tube. The results are presented in Table 3. We repeated the experiment using a standard dilution gas and found identical results illustrating that syngas can be used according to the process of the present invention.

Comparative Experiment A

Example 1 was repeated with a naphtha having the properties as listed in Table 2:

TABLE 2

| | |
|---|---|
| Density (d20/4)(g/ml) | 0.7198 |
| Initial boiling point (° C.) | 3 |
| 10 wt % (° C.) | 58 |
| 50 wt % (° C.) | 101 |
| 90 wt % (° C.) | 154 |
| 98 wt %(° C.) | 176 |
| Paraffins (wt %) | 61 |
| Naphthenics | 24 |
| Aromatics | 14 |
| Olefins | 1 |

TABLE 3

| Feed | Example 1 | Example 1 | Example 1 | Naphtha; Exp. A |
|---|---|---|---|---|
| Coil outlet temperature | 800 | 840 | 860 | 840 |
| Hydrogen (wt %) | 0.5 | 0.7 | 0.9 | 0.9 |
| Methane | 9.3 | 12.6 | 13.9 | 14.2 |
| Ethane | 3.6 | 3.3 | 3.0 | 3.3 |
| Ethylene | 30.9 | 35.4 | 36.6 | 28.4 |
| Propane | 0.7 | 0.5 | 0.4 | 0.4 |
| Propylene | 18.5 | 15.2 | 12.5 | 13.0 |
| $C_5$ minus | 86 | 83 | 80 | 72 |

The results in Table 3 show that excellent yields can be obtained with the relatively heavy Fischer-Tropsch synthesis product using the process according the invention. The results also show that with a much heavier Fischer-Tropsch feed a much higher yield to the $C_5$ minus range of compounds is achieved. This is surprising.

We claim:

1. A process to make ethylene and propylene from a carbonaceous feedstock, said process comprising (aa) preparing a gaseous mixture of carbon monoxide and hydrogen from a feedstock, (bb) performing a Fischer-Tropsch synthesis step using the gaseous mixture obtained in step (aa) to obtain a Fischer-Tropsch product, in admixture with unconverted carbon monoxide and hydrogen, (cc) performing a thermal cracking step on the Fischer-Tropsch product in admixture with the unconverted carbon monoxide and hydrogen of step (bb) to form ethylene and propylene.

2. A process according to claim 1, wherein the carbonaceous feed in step (aa) is a methane containing feed.

3. A process according to claim 1 wherein high boiling compounds of the Fischer-Tropsch product are separated by evaporating in an evaporation step low boiling compounds in the presence of a dilution gas to form a gas and a liquid fraction, and separating the liquid fraction from the remaining mixture of dilution gas and low boiling compounds.

4. A process according to claim 3, wherein prior to evaporating the low boiling compounds, light crude oil feedstock is added to the Fischer-Tropsch product, said light crude oil feedstock having according to ASTM D-2887 85 wt % or less compounds which will vaporize at 350° C., and 90 wt % or less compounds which will vaporize at 400° C.

5. A process according to claim 3, wherein the dilution gas as present in the effluent of step (cc) is recovered from said effluent and recycled to step (bb).

6. A process according to claim 3, wherein carbon dioxide is separated from the effluent of step (cc) in a cracked gas compression section and wherein the carbon dioxide is recycled to the evaporation step.

7. A process according to claim 2, wherein methane is separated from the effluent of step (cc) and used as feed in a process to prepare hydrogen.

8. A process according to claim 3, wherein the liquid fraction obtained in the evaporation step is subjected to a mild thermal cracking process and wherein the product obtained in said mild thermal cracking is recycled to step (cc).

9. A process according to claim 3, wherein the liquid fraction obtained in the evaporation step is subjected to a catalytic cracking step to obtain a gasoline fraction and a fraction boiling above said gasoline fraction.

10. A process according to claim 9, wherein the fraction boiling above the gasoline fraction is recycled to step (cc).

11. A process according to claim 9, wherein a gasoline fraction is mixed with the gasoline fraction isolated from the effluent of step (cc).

12. A process according to claim 3, wherein the liquid fraction obtained in the evaporation step is subjected to a hydroconversion/hydroisomerisation step to yield an effluent which is used at least in part as feed to step (cc).

13. A process according to claim 12, wherein from the effluent of the hydroconversion/hydroisomerisation step a naphtha fraction is isolated and wherein this fraction is combined with a gasoline fraction isolated from the effluent of step (cc).

14. A process according to claim 12, wherein a gasoline fraction isolated from the effluent of step (cc) is added to the feed of the hydroconversion/hydroisomerisation step and wherein a gasoline fraction is isolated from the effluent of said hydroconversion/hydroisomerisation step.

* * * * *